United States Patent [19]

Dauman

[11] Patent Number: 4,461,443

[45] Date of Patent: Jul. 24, 1984

[54] SELECTIVE POSITIONING ARTICLE SUPPORT STRUCTURE, PARTICULARLY FOR PEGBOARD-TYPE HOOK

[75] Inventor: Sidney M. Dauman, Beverly Hills, Calif.

[73] Assignee: Dauman Displays, Inc., New York, N.Y.

[21] Appl. No.: 320,770

[22] Filed: Nov. 13, 1981

[51] Int. Cl.[3] ..... E04G 3/00

[52] U.S. Cl. ..... 248/220.3; 211/87

[58] Field of Search ..... 248/220.3, 220.4, 221.2, 248/221.4, 224.2, 307, 298, 300; 211/87, 86

[56] References Cited

U.S. PATENT DOCUMENTS

| | | | |
|---|---|---|---|
| D. 173,720 | 12/1954 | Carver et al. | 248/300 X |
| 773,207 | 10/1904 | Kaiser | 248/300 X |
| 2,100,421 | 11/1937 | Wupper | 248/220.3 X |
| 2,437,535 | 3/1948 | Jenkins | 248/300 X |
| 3,278,149 | 10/1966 | Brucker | 248/300 X |
| 3,306,564 | 2/1967 | Nickel | 248/220.3 |
| 3,516,634 | 6/1970 | Salava et al. | 211/87 X |
| 3,830,374 | 8/1974 | Kassimir | 248/220.3 X |

FOREIGN PATENT DOCUMENTS

| | | | |
|---|---|---|---|
| 524533 | 12/1953 | Belgium | 248/298 |
| 103361 | 7/1962 | Netherlands | 248/220.3 |

*Primary Examiner*—Ramon S. Britts
*Assistant Examiner*—Blair M. Johnson
*Attorney, Agent, or Firm*—Frishauf, Holtz, Goodman & Woodward

[57] ABSTRACT

To permit random placement of pegboard-type hooks, without constraint of prepunched holes, and improve the weight carrying capability of the support structure for the hooks, a front panel (10) is formed in a box structure with side or end walls (17, 18, 19) and reinforced on the back side by orthogonally extending stiffening ribs (15, 16), with slots (13) extending through the front panel adjacent the stiffening ribs, so that the stiffening ribs with the adjacent front panel structure will form L-shaped rails, the pegboard-type hooks being extendable through the slots. The hooks can be moved along the slots, and located in position by positioning projections (25) extending underneath the horizontal stiffening ribs (16). A back panel (11) closes off the structure, preferably fitted to the front panel by an interengaging interlock and, possibly, additionally adhered thereto. The back panel is formed with grooves (26) within which the vertical ribs (15) fit to provide for additional stiffness.

13 Claims, 4 Drawing Figures

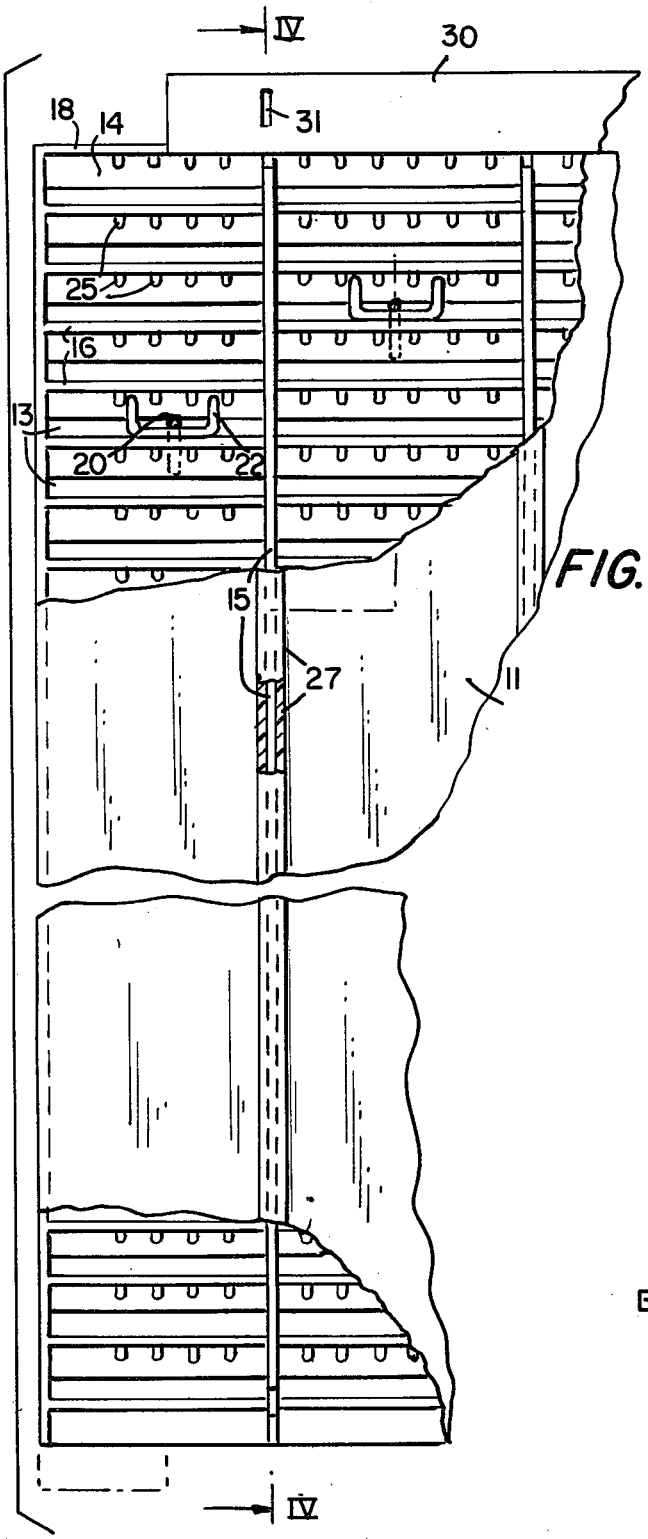
FIG. 3
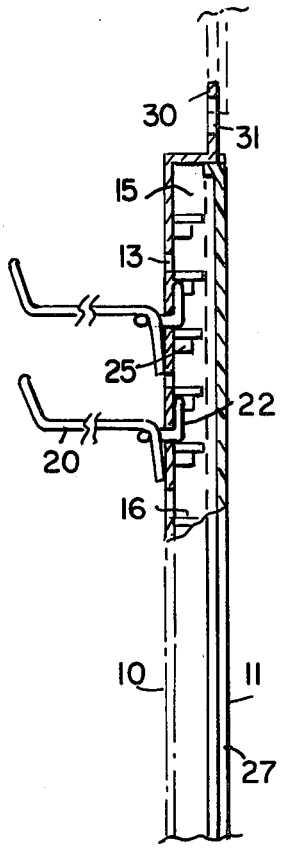
FIG. 4
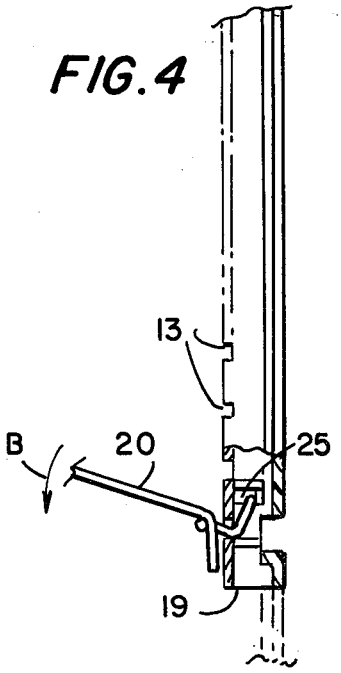

SELECTIVE POSITIONING ARTICLE SUPPORT STRUCTURE, PARTICULARLY FOR PEGBOARD-TYPE HOOK

Reference to related application, assigned to the assignee of this invention, and by the inventor hereof: U.S. Ser. No. 321,213, filed Nov. 13, 1981, DAUMAN, entitled "DISPLAY STAND STRUCTURE".

The present invention relates to an article support structure on which hook elements, of the aperture board type, can be placed at random positions, without constraint of a particular hole arrangement of aperture boards.

BACKGROUND

To display articles at point-of-sale displays, it is frequently desirable to support the articles by hooks which can be placed at selected positions in dependence on the size of the articles which are to be displayed and suspended. In many such installations, it has been customary to use aperture boards; aperture borads are frequently made of composition board material of limited weight-carrying characteristics and, particularly, comparatively weak in shear so that, if elongated hook-like members are placed through the holes of the boards and the weight on the hooks exceeds some rather small values, the board has a tendency to bow outwardly, and to tear out in the region of the hooks. The board is comparatively strong in compression, so that articles which are hung close to the board, not presenting a force-moment to the attachment region of the hooks, can be readily suspended; when used in point-of-sale display and support elements, however, a multiplicity of articles may be placed on elongated suspension hooks which place a strain on the board, requiring frequent and close attachment of the board to a sturdy back support panel, frame, or the like. The composition board usually used for aperture boards, e.g. of the type known under the trademark "PEGBOARD", is comparatively heavy and, once installed in a given location, can only be made smaller by cutting. The placement of the hooks to suspend the articles is defined by the holes placed into the board and closer or wider spacing is not possible without substantial reworking at an installation site which, additionally, weakens the board.

THE INVENTION

It is an object to provide an article support structure for use with aperture board-type hooks, which is versatile, lighter than composition aperture boards of equivalent size, and readily permits random placement of aperture board-type hooks at selected locations capable of supporting considerable weight.

Briefly, the structure comprises a front panel with stiffening ribs secured to the back side of the panel, the stiffening ribs preferably extending at right angles to each other up and down and across the panel which, for example, may be of square or rectangular size. The panel is formed with through-slots which extend parallel to and immediately adjacent the horizontal stiffening ribs, so that the horizontal stiffening ribs with the next adjacent portion of the front panel forms an L structural rail. Stiffening and positioning projections can be placed just underneath the rib, and attached to the back side of the front panel to provide locating pins to form positioning zones for aperture board hooks. These projections, for example in the form of buttons or the like, can be spaced close together to provide many more definitely defined positions for hooks than holes in an aperture board; or spaced widely apart to permit lateral sliding of hooks in the through-slots. The panel is enclosed around the outside by end walls so that, with the front panel and the end walls, and the stiffening ribs therein, an essentially box-like structure is formed which will be resistant to twisting and provide substantially improved stiffness with respect to an aperture board of equivalent area.

In accordance with a preferred feature of the invention, a back panel is additionally provided which is formed with grooves positioned to receive at least the upright stiffening ribs therein, and fitting against, or within the end walls, so that a closed box-like structure will result with additional intermediate stiffening ribs which are positively positioned on both the front and back panels.

The entire unit can be made of plastic, with the stiffening ribs, locating projections and end walls unitary with the front panel; if the back panel is used, it can be made removable from the front panel and fitted thereto by interengaging projection-and-recess elements, such as projecting flanges on one panel fitting into a corresponding cut-out in the other, or by adhesion, or the like.

The panel is particularly suitable for use in combination with a point-of-sale display stand described in my copending application entitled "DISPLAY STAND STRUCTURE", Ser. No. 321,213, filed Nov. 13, 1981.

DRAWINGS

FIG. 3 is a rear view of the assembled panel structure with the back panel partly broken away; and FIG. 4 is a part-sectional, part-side view of the structure, the section being taken along line IV—IV of FIG. 3.

Figure 1:
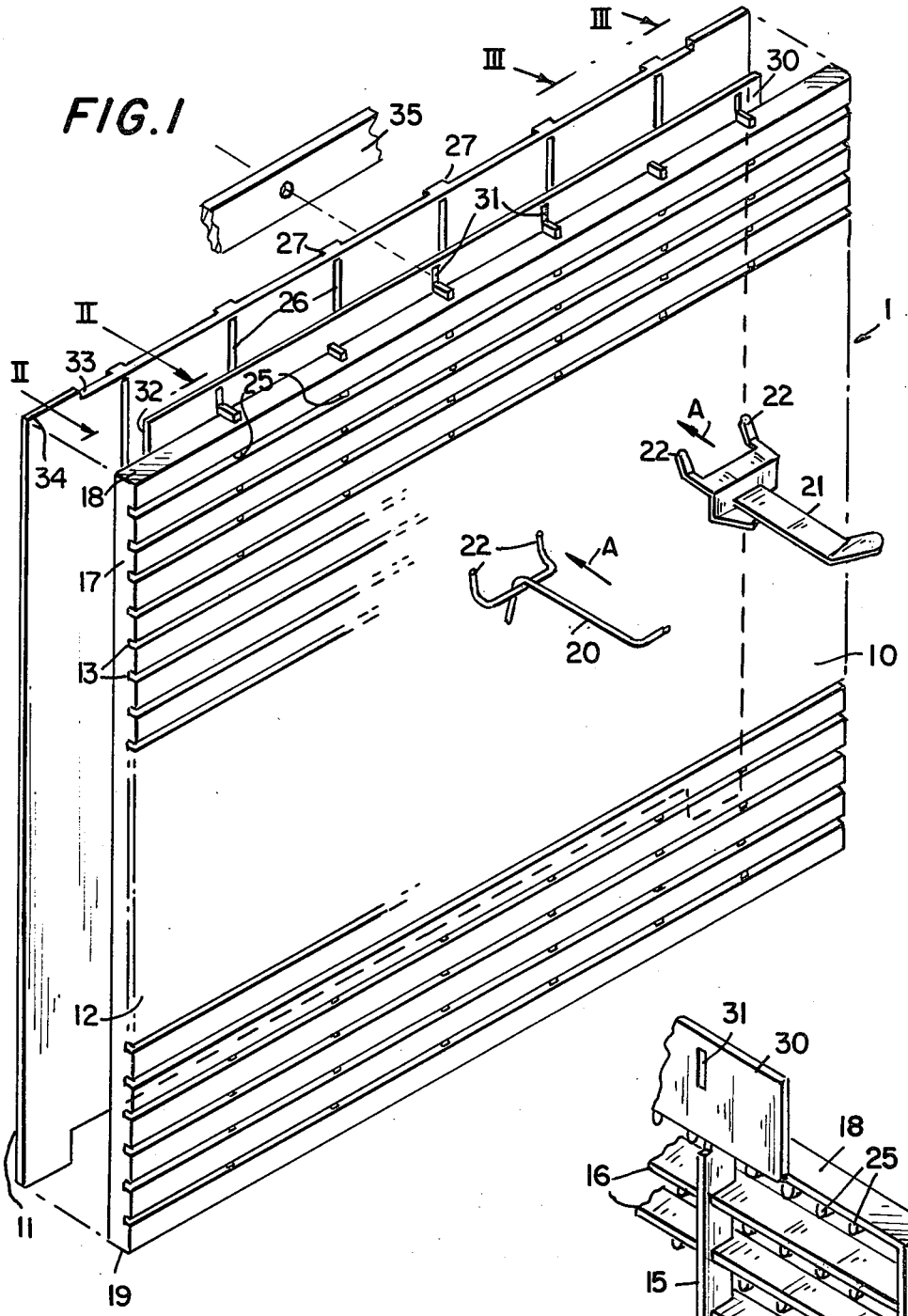
FIG. 1 is a pictorial representation—in exploded view—of the structure.

The support structure 1 (FIG. 1) has a front panel 10 and a back panel 11. Both the front and back panels are made of plastic, and can be joined together, for example by adhesion. The front panel 10 has a front surface 12. Parallel through-slots 13 extend through the front panel 10. Preferably, the front panel 10 is rectangular in plan view (see FIGS. 1, 3) and the slots extend in a direction which will be termed "horizontal" since, in actual use, the panel will be placed in this position. The slots 13 receive hangers 20, 21 of the aperture board type construction. The hangers 20, 21 may be of any suitable form, as required by the structure of the articles to be supported by the panel. Two types of such hangers are shown. Other types of support structures, hangers, and the like may be used with the panels. The hangers 20, 21 have projecting fingers 22 which, when inserted in the direction of the arrow A into the slots 13, and upon then being tipped downwardly in direction of arrow B—FIG. 4—will lock in place behind the rear surface 14 of the front panel 10.

A group of vertical ribs 15 is secured to the front panel 10, for example by being molded integrally therewith. The ribs 15 extend behind the panel 10 by a distance which is sufficiently deep to permit insertion of the fingers 22 of the hooks 20, 21 behind the front panel without engaging the front surface of the rear panel 11. A group of horizontal ribs 16 (FIGS. 2, 3) extend transversely across the rear face of the panel 10, for example by being molded thereto, and molded integrally also with the vertical ribs 15. The horizontal ribs 16 join the front panel 10 at the edge of the slots 13 to form, together with the adjacent portion of the front panel, an L structure which, as is well known, is highly resistant to twisting and provides strong support in three dimensions. The front panel 10, thus, is subdivided to form a series of L-rail structures, extending horizontally, and vertically reinforced and supported by the vertical ribs 15.

The stiffness of the entire structure is further enhanced by enclosing it on all sides by end walls, of which only the vertical wall 17 and the horizontal walls 18, 19 are visible in the drawings. Thus, the front panel with the end walls therearound forms a laterally enclosed box structure which, consequently, will be stiff and rigid; further, the placement of the ribs 15 provides for substantial weight carrying capability vertically, with respect to the placement of the panel.

The region or zone within the angle formed by the L structure of the portion of the front panel 10 adjacent the slot 13 is additionally reinforced and subdivided by projections 25, which extend in the form of buttons or ridges rearwardly from the front panel, just underneath the horizontal rib. These buttons or ridges 25 are molded integrally with the remainder of the structure, and thus are integral with the front panel and the horizontal as well as the vertical ribs. The projections or ridges are spaced from each other by a suitable distance as determined by the distance between the fingers 22 of the hooks 20, 21. For example, these ridges may be placed every ½ inch (about 12 mm) apart. They prevent excessive lateral shifting of the hooks 20, 21; yet, they permit widely varying spacing between adjacent hooks by allowing for some lateral shift—for example 1 cm, or just under ½ inch, that is, the spacing of the projections or buttons less their thickness. Thus, the constraint of placement of the hooks formed by aperture boards with holes is eliminated, and practically complete random placement of the hooks, horizontally, is possible. The vertical spacing of the grooves 13 also can be much closer than that of aperture board holes, which are usually spaced about 1" (2½ cm) apart. A suitable spacing of the grooves, for example, is anywhere from ½" to 1", for example ¾" (about 18 mm), thereby permitting greater versatility in spacing of the hooks longitudinally of the support structure.

The back panel 11 has grooves 26 formed therein, which are placed in alignment with the vertical ridges 15. The vertical ridges 15 preferably project behind the outline of the horizontal ridges or ribs 16 and the end walls 17, 18, 19, as best seen in FIG. 2. The grooves 26 are arranged to receive the vertical ribs 15, and the back panel is large enough to fit snugly against the end walls 17, 18, 19 of the front panel as well as against the cross ribs 16. Preferably, the back panel is reinforced with reinforcing ridges 27 just behind the grooves 26 (see FIG. 1).

Figure 2:
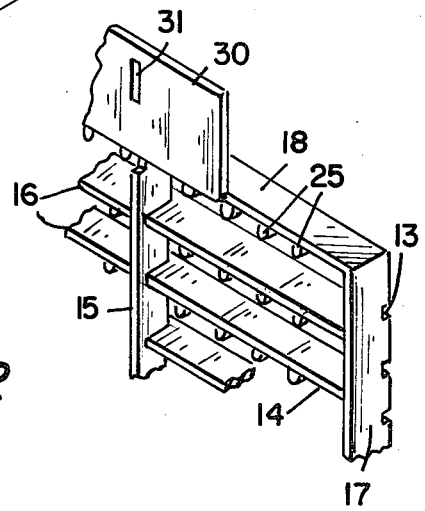
FIG. 2 is a fragmentary pictorial representation of a rear end and corner portion of the structure.

The panel can be attached to a support, schematically shown in FIG. 1 as a structural member 35 which, for example, may be a display support bar of plastic, wood, metal, or the like. The front panel 10 is formed with an extending flange 30 which has preferably elongated holes 31 passing therethrough to permit attachment of the flange 30 to the structural member 35. The flange 30 terminates short of the vertical end wall 17—and the opposite wall—to form a shoulder 32 which interlocks with a matching recess 33 relieved from the end portion 34 of the back or rear panel 11 to form engagement surfaces to interlock the front and the rear panel. Additional attachment means can be used, and besides the interlock, the rear panel 11 can be secured to the front panel 10, at the engaging surfaces of the end walls 17, 18, 19, as wall as between the ribs 15 and the grooves 26 by plastic welding, heat adhering, adhesives or the like. The interlocking arrangement alone, however, provides for a sturdy assembly by forming the front panel, with its side walls and ribs, and the rear panel into a single closed box structure, thus providing for substantial strength, weight carrying and capability, while effectively resisting twisting and bending forces which may be introduced by uneven weight distribution of articles suspended from hooks 20, 21 and other hooks placed on the panel. The resistance to twist is further enhanced by locating the attachment holes 31 in the flange 30 at least essentially in alignment with the vertical ribs 15.

Various changes and modifications may be made within the scope of the inventive concept. For example, the width of the slots 13 is determined essentially by the thickness of the material to be passed therethrough, that is, the fingers 22. For use with standard apeture board hooks, a width of slightly over ¼" (about 4 mm) is suitable, but other dimensions may be used in dependence on the structure of the hook element. As a further example, it is not strictly necessary that the two groups of ribs 15, 16 extend at right angles to each other. The ribs 16, of course, should extend horizontally, upon placement of the panel, for proper support of the hooks 20, 21. The other ribs may, however, extend for example at an angle of 60°, in either direction, to form a honeycomb structure, intersected by the slots 13; or may extend at 45° angles to form a diamond-web structure, again intersected by the slots 13. While the resistance to twist may thereby be increased, the load carrying capability, in a vertical direction, may be decreased. In a preferred form, and for a sales display and dispensing application, the arrangement of the ribs as shown in the drawings, that is, at right angles, is preferred. This, also, results in a cheaper mold for molding the panel of plastic.

I claim:

1. Selective positioning article support structure for combination with hook members (20, 21, 22) having a predetermined thickness comprising a front panel (10) having a front side (12) and a back side;

a group of first stiffening ribs (15) secured to the back side of the front panel and extending in a first direction;

a group of second stiffening ribs (16) secured to the back side of the front panel and extending in a second direction which forms an angle of at least 45° with respect to said first direction;

slots (13) formed in the front panel (10) and just slightly wider than said predetermined thickness of the hook members, and extending parallel to and adjacent one (16) of the groups of stiffening ribs (15, 16);

and end walls (17, 18, 19) extending around the outer circumference of the panel, and essentially laterally enclosing the first and second groups of stiffening ribs (15, 16); and wherein the front panel (10), the end walls, and the first and second groups of stiffening ribs (15, 16) are all of plastic material and formed as a unitary structure with the front panel; and the stiffening ribs (16) of said one of the groups, together with portions of the front panel adjacent the slots, form an "L" structural rail element to provide stiffness to the front panel and render it resistant to twisting.

2. Structure according to claim 1, wherein the first and second groups of stiffening ribs (15, 16) extend at right angles with respect to each other.

3. Structure according to claim 1, wherein the slots extend horizontally, when the panel is mounted upright or vertically.

4. Structure according to claim 1, wherein a back panel (11) is provided, extending parallel to the front panel (10);

the ribs of one group extend from the back side of the front panel (10) by at least the same dimension as the end walls;

and the back panel (11) comprises a flat, sheet-like element formed with grooves receiving the ribs of said at least one group, and fitting snugly to the end wall (17, 18, 19) of the front panel to form, together with the front panel, a complete, enclosed box structure.

5. Structure according to claim 4, wherein the back panel is formed with reinforcing ribs at the side thereof opposite the grooves.

6. Structure according to claim 4, wherein the front panel has an extending attachment flange (30) joined to an end wall (18), the back panel and front panel including interlocking projection-and-recess means (32, 33, 34) in the region of the flange on the front panel.

7. Structure according to claim 1, wherein the front panel has an extending attachment flange (30), and attachment holes (31) extend through the attachment flange and in essential alignment with at least some of the stiffening ribs (15) extending to the end walls (18) to which the flange is joined.

8. Structure according to claim 1, further including regularly spaced locating projections (25) formed on the back side of the front panel (10 ) in the angle included by the "L" structural zone.

9. Structure according to claim 1, wherein a back panel of plastic material, is fitted against one of said groups of stiffening ribs and forms a unitary plastic structural assembly with the end walls and the front panel.

10. Structure according to claim 3, wherein the ribs of one group extend from the back side of the front panel by at least the same dimension as the end walls;

a back panel (11) is provided, comprising a flat, sheet-like element formed with grooves receiving the ribs of said one of the groups of ribs, and fitting snugly to the end wall (17, 18, 19) of the front panel to form, together with the front panel, a complete, enclosed box structure;

wherein the front panel has an extending attachment flange (30) joined to an end wall (18), the back panel and front panel including interlocking projection-and-recess means (32, 33, 34) in the region of the flange on the front panel;

wherein the attachment flange (30), is formed with attachment holes (31) extending through the attachment flange and in alignment with at least some of the stiffening ribs (15) and extending to the end walls (18) to which the flange is joined;

further including regularly spaced locating projections (25) formed on the back side of the front panel (10) in the angle included by the "L" structural zone;

and wherein the end walls (17, 18, 19) and said locating projections (25) together with the groups of ribs and said front panel form a unitary plastic structural element;

and said back panel (11) is a plastic sheet fitted on and secured to said front panel to unite the front panel and back panel to form an essentially closed box-like structure resistant to deformation and twisting.

11. Selective positioning article support structure for combination with hook members (20, 21, 22) having a predetermined thickness comprising a front panel (10) having a front side (12) and a back side;

a group of first stiffening ribs (15) secured to the back side of the front panel and extending in a first direction;

a group of second stiffening ribs (16) secured to the back side of the front panel and extending in a second direction which forms an angle of at least 45° with respect to said first direction;

slots (13) formed in the front panel (10) and just slightly wider than said predetermined thickness of the hook members, and extending parallel to and adjacent one (16) of the groups of stiffening ribs (15, 16);

end walls (17, 18, 19) extending around the outer circumference of the panel, and essentially laterally enclosing the first and second groups of stiffening ribs;

and a back panel (11) extending parallel to the front panel (10);

wherein the ribs of one group extend from the back side of the front panel (10) by at least the same dimension as the end walls;

the back panel (11) omprises a flat, sheet-like element formed with grooves receiving the ribs of said at least one group, and fitting snugly to the end wall (17, 18, 19) of the front panel to form, together with the front panel, a complete, enclosed box structure;

and wherein portions of the front panel (10) adjacent the slots form, together with said one (16) of the groups of stiffening ribs, an "L" structural element to provide stiffness to the front panel and render it resistant to twisting.

12. Structure according to claim 11, wherein the back panel is formed with reinforcing ribs at the side thereof opposite the grooves.

13. Structure according to claim 11, wherein the front panel has an extending attachment flange (30) joined to an end wall (18), the back panel and front panel including interlocking projection-and-recess means (32, 33, 34) in the region of the flange on the front panel.

* * * * *